United States Patent [19]

Brouwer

[11] Patent Number: 4,550,665

[45] Date of Patent: Nov. 5, 1985

[54] BOTTOM DISCHARGE HOPPER STRUCTURES

[75] Inventor: Cornelis Brouwer, Potchefstroom, South Africa

[73] Assignee: Rotaque (Proprietary) Limited, Potchefstroom, South Africa

[21] Appl. No.: 583,494

[22] Filed: Mar. 1, 1984

Related U.S. Application Data

[63] Continuation of Ser. No. 902,319, May 3, 1978, abandoned.

[30] Foreign Application Priority Data

May 4, 1977 [ZA] South Africa ..... 77/2681

[51] Int. Cl.[4] ..... B61D 7/30; B61D 7/04; B61D 7/18

[52] U.S. Cl. ..... 105/241.2; 105/247; 105/283; 222/460

[58] Field of Search ..... 105/241.1, 241.2, 247, 105/248, 249, 254, 283; 222/457, 460, 462

[56] References Cited

U.S. PATENT DOCUMENTS

| | | | |
|---|---|---|---|
| 702,731 | 6/1902 | Hoover et al. | 222/457 X |
| 719,686 | 2/1903 | Randel | 105/249 |
| 816,070 | 3/1906 | Brown | 105/249 |
| 1,105,948 | 8/1914 | Wright | 105/283 X |
| 1,422,133 | 7/1922 | Robider | 105/247 |
| 1,594,863 | 8/1926 | Warner | 214/63 |
| 1,719,393 | 7/1929 | Covington | 222/457 X |
| 2,030,553 | 2/1936 | Tiley | 105/247 X |
| 3,099,229 | 7/1963 | Wethly | 105/254 |
| 3,515,051 | 6/1970 | Pulcrano | 105/247 |
| 3,790,008 | 2/1974 | Joubert | 105/241 C |
| 4,062,460 | 12/1977 | Adler | 105/241 C |

*Primary Examiner*—Randolph A. Reese
*Assistant Examiner*—David F. Hubbuch
*Attorney, Agent, or Firm*—Pollock, Vande Sande & Priddy

[57] ABSTRACT

A hopper car in which the body has vertical end walls and side walls each comprising a sloping lower portion and a vertical upper portion. The two sloping lower portions converge downwardly and their horizontal lower edges define a discharge opening. One of these edges lies in a horizontal plane which is at a different level to the plane containing the other lower edge. The angle of slope of one lower portion is different to the angle of slope of the other lower portion. Additionally, the horizontal plane containing the line of convergence between the one lower portion and its associated upper portion lies in a different horizontal plane to the corresponding line of convergence of the other side wall. An arcuate door carrying a laterally protruding operating arm closes-off the discharge opening.

8 Claims, 5 Drawing Figures

BOTTOM DISCHARGE HOPPER STRUCTURES

This is a continuation application under 37 CFR 1.62 of prior application Ser. No. 902,319, filed on May 3, 1978 (abandoned).

This invention relates to bottom discharge hopper structures, and in particular to bottom discharge hopper rail cars.

According to one aspect of the present invention there is provided a bottom discharge hopper rail car comprising a hopper body mounted on a chassis and a door pivotally mounted on the body, the body having a pair of downwardly converging, laterally spaced side walls the longitudinally extending lower edges of which define a discharge opening from the body, the angle of one side wall with respect to horizontal being different to the angle of the other side wall with respect to horizontal, and the door being displaceable between a position in which it closes said opening and a position in which it is spaced from said opening to permit discharge of the contents of said body.

According to a further aspect of the present invention there is provided a hopper structure comprising a body having a pair of downwardly converging, laterally spaced side walls the longitudinally extending lower edges of which define a discharge opening from the body, a door pivotally mounted on the body, the door being displaceable between a position in which it closes said opening and a position in which it is spaced from said opening to permit discharge of the contents of said body, a pair of laterally spaced upright side walls each of which extends upwardly from the longitudinally extending upper edge of a respective one of the converging side walls, the line along which one converging side wall and its associated upright wall meet being offset in the vertical direction with respect to the line along which the other converging side wall and its associated upright wall meet.

According to a still further aspect of the present invention there is provided a hopper structure comprising a body having a pair of downwardly converging, laterally spaced side walls longitudinally extending lower edges of which define a discharge opening from the body, a door pivotally mounted on the body, the door being displaceable between a position in which it closes said opening and a position in which it is spaced from said opening to permit discharge of the contents of said body, the angle of one side wall with respect to horizontal being different to the angle of the other side wall with respect to horizontal, a pair of laterally spaced upright side walls each of which extends upwardly from the longitudinally extending upper edge of a respective one of the converging side walls, the line along which one converging side wall and its associated upright wall meet being offset in the vertical direction with respect to the line along which the other converging side wall and its associated upright wall meet.

For simplicity of construction, said lines are preferably horizontal.

The hopper body is preferably mounted on a wheeled chassis to form a bottom discharge hopper rail car.

For a better understanding of the present invention, and to show how the same may be carried into effect, reference will now be made, by way of example, to the accompanying drawings, in which.

Figure 1:
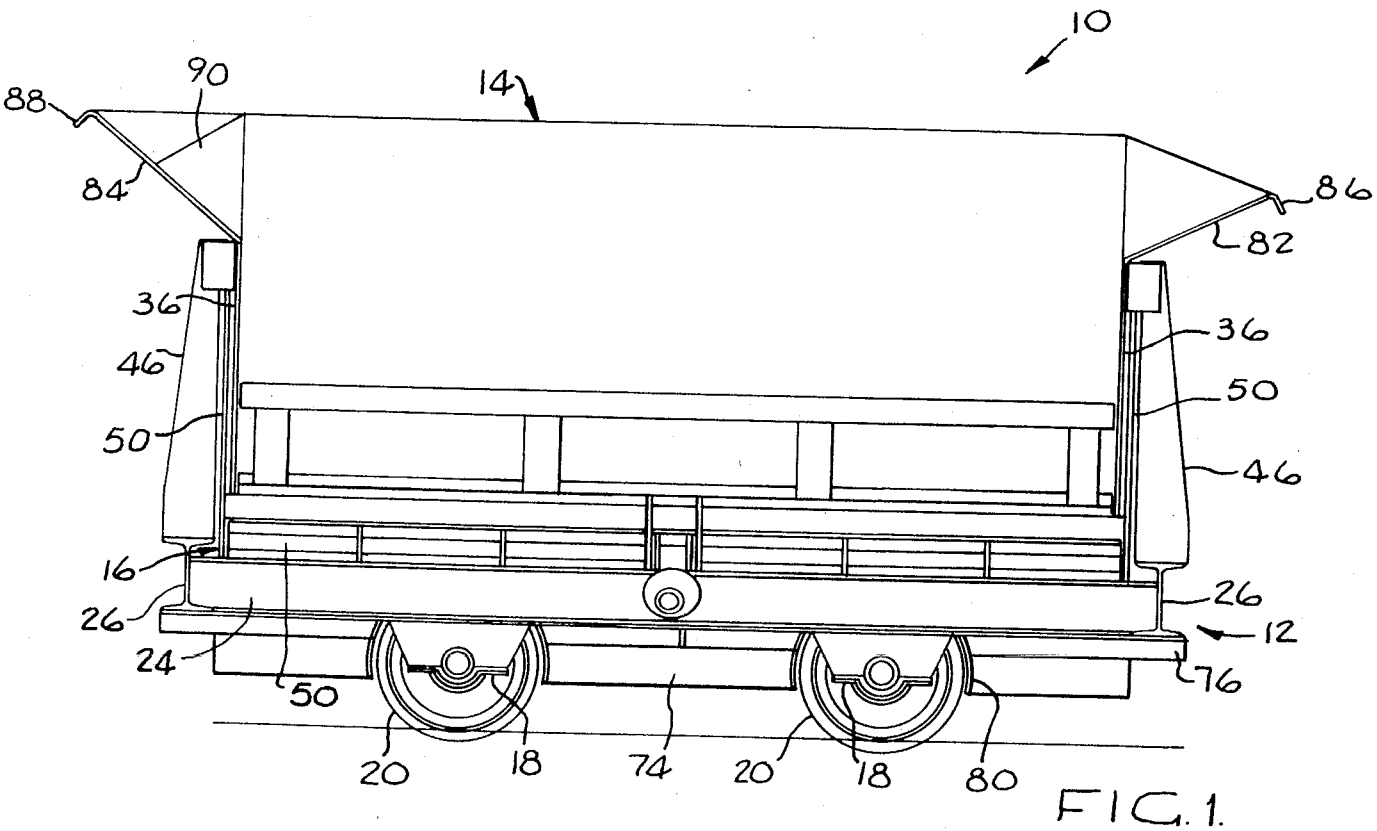
FIG. 1 is a side elevation of a bottom discharge hopper car.
Figure 2:
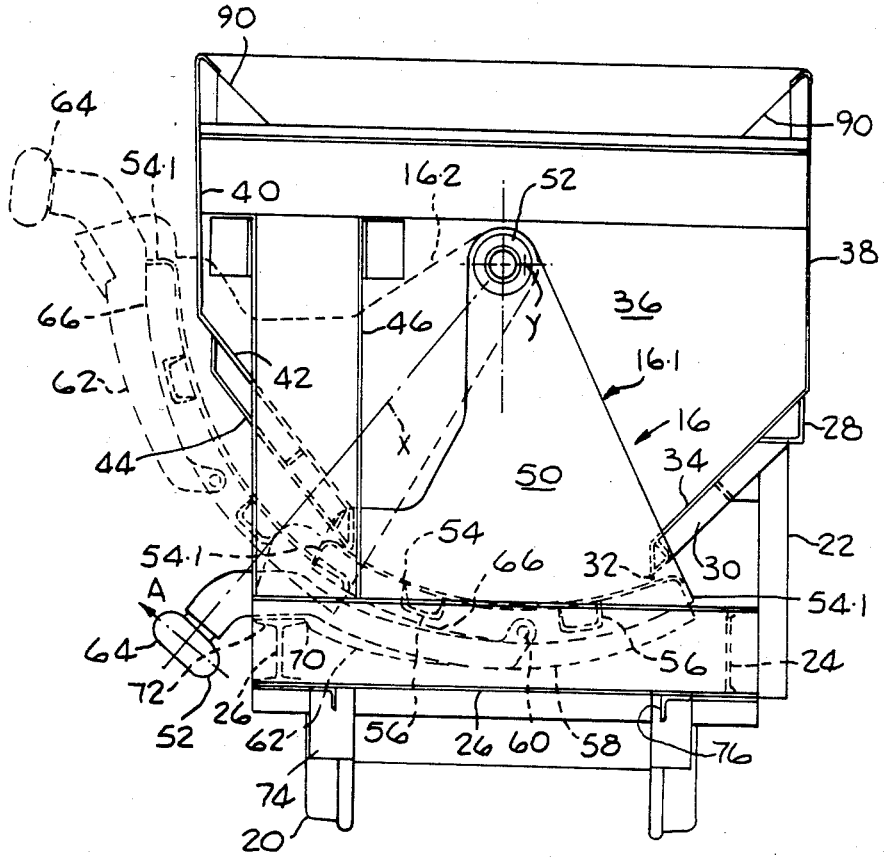
FIG. 2 is an end elevation of the hopper car of FIG. 1.
Figure 4:
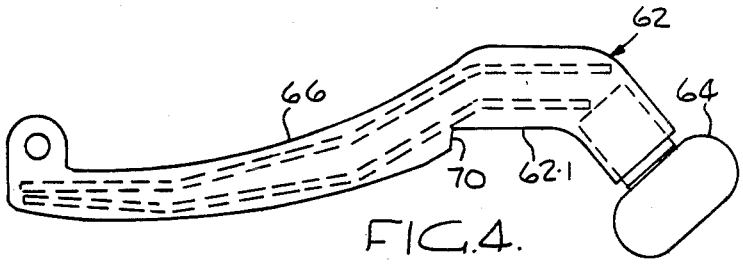
FIG. 4 is a side elevation of a tipping arm.
Figure 5:
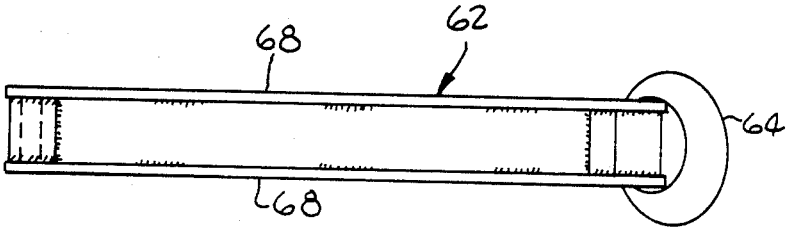
FIG. 5 is a top plan view of the arm of FIG. 4.
Figure 3:
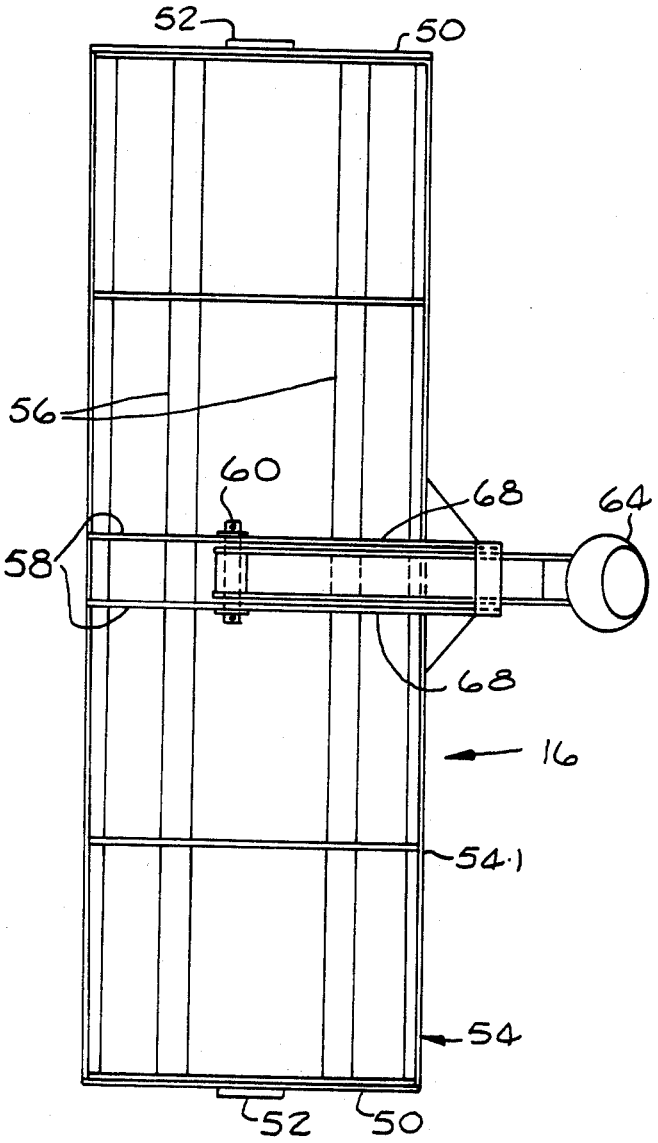
FIG. 3 is an underneath plan view of the door of the car.

The hopper car illustrated in FIGS. 1 and 2 is generally referenced 10 and comprises a chassis 12, a hopper body 14, and a door 16.

The chassis 12 includes two sets of wheel bearings 18 which mount flanged wheels 20. A series of supports 22 extend upwardly from a frame which forms a major part of the chassis 12 and which is itself constituted by a longitudinal channel iron 24 and longitudinal and transverse I-beams 26. The supports 22 are welded to the longitudinal channel iron 24.

An angle iron 28 is mounted on the supports 22 and stiffeners 30 extend downwardly from the angle iron 28 towards the free lower edge 32 of a sloping wall 34 of the hopper body 14.

In addition to the sloping wall 34, the hopper body 14 comprises two end walls 36, a vertical wall 38 extending upwardly from the sloping wall 34, a further vertical wall 40 which is parallel to, and spaced laterally from, the vertical wall 38, and a further sloping wall 42. The sloping wall 42 is strengthened by stiffeners 44 which extend from the region of the convergence between the vertical wall 40 and the sloping wall 42 to the lower edge of the wall 42.

As will be clearly understood from the following description, the door 16 swings between the full and dotted line positions illustrated at 16.1 and 16.2 in FIG. 2. To permit this movement to take place, while still providing some support for the hopper body on this side of the car, two vertically elongated supports 46 of I-section are provided. The supports 46 extend between the transverse I-beams 26 of the frame 14 and are secured to the walls 36.

The door 16 comprises two approximately triangular end plates 50 which are carried pendulum fashion by overhead pivot structures 52. The overhead pivot structures 52 mount the end plates 50 on the end walls 36 of the hopper body 14.

The door 16 further includes a curved base plate 54 (the concave face of the base plate being uppermost) which extends between and is secured to the end plates 50. The base plate 54 is strengthened by a pair of channels 56 which extend downwardly from the underside thereof. The edges 54.1 of the base plate 54 are turned downwardly which also enhances its strength.

Centrally of the door, that is, midway between the plates 50, the door is provided with two curved, transversely extending stiffeners 58. A pivot pin 60 is mounted on the parallel stiffeners 58 and the pin 60 pivotally mounts an arm 62. The arm has a roller 64 rotatably mounted at the outer end thereof.

The upper face of the arm 62 is shown at 66 and it will be seen that this, in the closed position of the door, is spaced from the turned-down edge 54.1 which lies thereabove. The face of the edge 54.1 constitutes an abutment surface of the door and the co-operating portion of the arm constitutes an abutment face on the arm. When the outer end of the arm 62 is lifted upon the roller 64 encountering a ramp (see FIGS. 6 etc.), there is some lost motion between the arm 62 and the door 16. More specifically, the arm 62 lifts, pivoting about the pin 60 with respect to the door 16, until the gap between this turned-down edge 54.1 and the arm has been taken up. Thereafter, further swinging movement of the arm 62 in an upward direction towards the dotted line position shown in FIG. 2 causes the door 16 to lift. It will be noted that in this position the arm 62 is in engagement with the turned-down edge 54.1. Discharge of the material in the hopper body then takes place, the material sliding downwardly over the walls 34 and 42 and through the rectangular frame constituted by the channel 24 and I-beams 26.

The arm 62 includes two plates 68 which are parallel to one another but spaced apart in the longitudinal direction of the car. Each of these plates has a stepped undersurface, the arrangement being such as to provide two faces 70 which, in the closed condition of the door, are vertical.

The upper face 66 of the arm 62 is constituted by the parallel, aligned, upper faces of the plates 68.

As will be seen from FIG. 2, the faces 70 engage one edge of the upper flange 72 of the longitudinal I-beam 26 so that, in the closed condition of the door, lateral movement of the arm and door towards the open position is prevented. During the upward lost motion of the arm 62 with respect to the base plate 54, the faces 70 clear the edge of the upper flange 72 of the I-beam 26. Consequently, by the time the arm engages and commences to lift the door in its outward swinging movement, the vertical faces 70 are clear of the I-beam which, as a consequence, does not hinder such movement.

During the closing movement of the door, the door and arm swing downwardly together until the door reaches its fully closed position. Thereafter the arm moves downwardly away from the door and the faces 70 are re-engaged with the flange 72. Downward movement of the arm 62 ceases when the surfaces 62.1 of the arm come to rest on the I-beam 26.

The axis of rotation of the roller 64 is shown at X in FIG. 2 and it will be seen that this passes through the common axis of the pivot structures 52. The curved base plate 54 of the door 16 is generated about the longitudinal axis Y.

By off-setting the axis Y horizontally from the common axis of the pivot structures 52, the motion imparted to the door 16, while being a true pendulum motion, includes a downward component with respect to the stationary parts of the hopper. This means that those portions of the door which are in sealing engagement with the lower edges of the walls 34 and 42 of the hopper body do not simply swing laterally with respect thereto which can cause ore or other material to be trapped therebetween. Instead, said portions simultaneously swing laterally and move downwardly with respect to said stationary parts so that gaps of progressively increasing width are created. This obviates the possibility of ore wedging the door solidly to the body and thereby prevents the car being tipped over by the ramp.

The chassis 12 incorporates, on each side thereof, a skirt 74 which prevents spreading of the load when it is being discharged. The skirts 74 are themselves stiffened by angle irons 76.

The two skirts are cut away to provide clearance for the wheels of the vehicle and the wheel arches thus formed are strengthened by welding on elements 80 (see FIG. 1).

As will be seen from FIG. 1, there are, at the upper ends of the end walls 36 of the hopper body 14, diverging guide walls 82 and 84 which constitute overhanging portions of the body. The guide wall 82 slopes at an angle of less than 45 degrees and terminates in a downwardly directed lip 86. The wall 84 slopes at about 45 degrees and also terminates in a lip 88. A comparison of the wall 82 with the wall 84 reveals that, when two hopper cars are coupled end-to-end in a train, the wall 84 and its lip 88 overhang the wall 82 and its lip 86. Thus, when the car is filled while moving under a continuous discharge of ore or the like, the overhanging walls 82 and 84 ensure that material cannot be dumped between the cars onto the track.

When the hopper cars negotiate a bend in the track, the laterally outer ends of the wall 82 move one forwardly and one rearwardly with respect to the overhanging wall 84. To prevent engagement of the wall 82 with the wall 84, the end portions of the wall 84 are formed with vee-shaped notches 90 as shown in FIG. 2. With this arrangement the ends of the wall 82 swing into these notches so that the train can round the bend safely without any of the trucks being de-railed.

The sloping walls 34 and 42 are asymmetrically arranged with respect to one another insofar as their angles of slope are concerned and/or insofar as the disposition of their upper and lower edges in the horizontal plane is concerned. More specifically, the two walls slope at different angles and, moreover, the horizontal plane containing the convergence between the walls 34 and 38 is at a different vertical level to the horizontal plane containing the convergence between the walls 40 and 42. The lower edges of the walls 42 and 34 are also in a different plane. By means of this asymmetrical arrangement of the walls, the tendency of material contained in the hopper body to 'bridge' when efforts are made to discharge it are minimised.

I claim:

1. A bottom discharge hopper rail car comprising a hopper body mounted on a chassis and a door pivotally mounted on the body, the chassis including wheels rotatable about axes extending in the transverse direction of the car, the body having a pair of inclined, downwardly converging side walls spaced apart in said transverse direction of the car, the longitudinally extending lower edges of the side walls defining a discharge opening from the body, the angle of inclination of one side wall with respect to horizontal being different to the angle of inclination of the other side wall with respect to horizontal, and the door being displaceable between a position in which it closes said opening and a position in which it is spaced from said opening to permit discharge of the contents of said body.

2. A hopper rail car according to claim 1, in which said lower edges are offset from one another in a vertical direction.

3. A bottom discharge hopper rail car comprising a hopper body mounted on a chassis, the chassis including wheels rotatable about axes extending in the transverse direction of the car, the body having a pair of inclined downwardly converging side walls spaced apart in said transverse direction of the car, the longitudinally extending lower edges of the side walls being spaced apart horizontally and defining a downward discharge opening from the body, a door pivotally mounted on the body for opening and closing movement about a horizontal axis, the axis about which the door is pivotally mounted being horizontal, above both said edges, and in a vertical plane which lies between said edges, the door being displaceable between a position in which it cooperates with both said edges to close said opening and a position in which it is spaced from both said edges to permit discharge of the contents of said body through said opening, a pair of upright side walls spaced in said transverse direction and each extending upwardly from the longitudinally extending upper edge of a respective one of the converging side walls, the line along which one converging side wall and its associated upright wall meet being offset in the vertical direction with respect to the line along which the other converging side wall and its associated upright wall meet.

4. A hopper structure according to claim 3, in which said lines are horizontal.

5. A hopper structure according to claim 3, in which said lower edges are offset from one another in the vertical direction.

6. A bottom discharge hopper rail car comprising a hopper body mounted on a chassis, the chassis including wheels rotatable about axes extending in the transverse direction of the car, the body having a pair of inclined downwardly converging side walls spaced apart in said transverse direction of the car, the longitudinally extending lower edges of the side walls defining a discharge opening from the body, a door pivotally mounted on the body, the door being displaceable between a position in which it closes said opening and a position in which it is spaced from said opening to permit discharge of the contents of said body, the angle of inclination of one side wall with respect to horizontal being different to the angle of inclination of the other side wall with respect to horizontal, a pair of upright side walls spaced in said transverse direction and each extending upwardly from the longitudinally extending upper edge of a respective one of the converging side walls, the line along which one converging side wall and its associated upright wall meet being offset in the vertical direction with respect to the line along which the other converging side wall and its associated upright wall meet.

7. A hopper structure according to claim 6, in which said lines are horizontal.

8. A hopper structure according to claim 6, in which said lower edges are offset from one another in a vertical direction.

* * * * *